US007086476B2

(12) United States Patent
Johnson et al.

(10) Patent No.: US 7,086,476 B2
(45) Date of Patent: Aug. 8, 2006

(54) EXPANDABLE DEVICES AND METHOD

(75) Inventors: Craig D. Johnson, Letchworth (GB); Matthew R. Hackworth, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 88 days.

(21) Appl. No.: 10/452,322

(22) Filed: Jun. 2, 2003

(65) Prior Publication Data

US 2004/0026079 A1 Feb. 12, 2004

Related U.S. Application Data

(60) Provisional application No. 60/385,778, filed on Aug. 6, 2002.

(51) Int. Cl.
*E21B 43/08* (2006.01)

(52) U.S. Cl. ..... 166/380; 166/207

(58) Field of Classification Search ..... 166/380, 166/384, 206, 207

See application file for complete search history.

(56) References Cited

U.S. PATENT DOCUMENTS

| | | | |
|---|---|---|---|
| 5,366,012 | A | 11/1994 | Lohbeck |
| 5,397,355 | A | 3/1995 | Marin et al. |
| 5,562,697 | A | 10/1996 | Christiansen |
| 5,618,299 | A | 4/1997 | Khosravi et al. |
| 5,695,516 | A | 12/1997 | Fischell et al. |
| 5,924,745 | A | 7/1999 | Campbell |
| 5,928,280 | A | 7/1999 | Hansen et al. |
| 5,972,018 | A | 10/1999 | Israel et al. |
| 6,004,348 | A | 12/1999 | Banas et al. |

(Continued)

FOREIGN PATENT DOCUMENTS

| | | | |
|---|---|---|---|
| DE | 197 28 337 | A1 | 1/1999 |
| EP | 0 897 698 | A2 | 2/1999 |
| EP | 1 031 329 | A2 | 8/2000 |
| EP | 1 042 997 | A1 | 10/2000 |
| EP | 1 223 305 | A3 | 11/2002 |
| GB | 2 368 082 | A | 4/2002 |
| GB | 2 371 066 | A | 7/2002 |
| WO | WO 98/20810 | A1 | 5/1998 |
| WO | WO 98/32412 | A | 7/1998 |
| WO | WO 99/15108 | A2 | 4/1999 |

OTHER PUBLICATIONS

US 6,706,063, 3/2004, Besselink (withdrawn)

Besselink, Peter; Biflex Stents; SMST–99: Proceedings of the First European Conference on Shape Memory and Superelastic Technologies, Antwerp Zoo. Belgium, 1999; pp 142–150.

Docket Sheet for Memry Corporation v. Kentucky Oil Technology, N.V., Case No. H–04–1959 (S.D. Tex.) (PACER Jun. 2, 2005) (5 pages).

Docket Sheet for Memry Corporation v. Kentucky Oil Technology, N.V., Case No. C–04–03843, (N.D. Cal.) (PACER Aug. 11, 2005) (13 pages).

(Continued)

*Primary Examiner*—William Neuder
(74) *Attorney, Agent, or Firm*—Robert A. Van Someren; Kevin P. McEnaney; Jaime A. Castano

(57) ABSTRACT

The present system and method comprises an expandable device for use in wellbores. In one embodiment, the present device comprises a plurality of slots disposed within the device. The slots define expansion compensation portions, wherein the compensation portions facilitate radial expansion of the device while concurrently maintaining essentially constant the axial length of the device. The present technique also comprises a method of forming the device in accordance therewith.

25 Claims, 7 Drawing Sheets

U.S. PATENT DOCUMENTS

| | | | | |
|---|---|---|---|---|
| 6,017,362 | A | 1/2000 | Lau | |
| 6,022,371 | A | 2/2000 | Killion | |
| 6,065,500 | A | 5/2000 | Metcalfe | |
| 6,083,258 | A | 7/2000 | Yadav | |
| 6,190,406 | B1 | 2/2001 | Duerig et al. | |
| 6,293,967 | B1 * | 9/2001 | Shanley | 623/1.15 |
| 6,488,702 | B1 | 12/2002 | Besselink | |
| 6,527,799 | B1 * | 3/2003 | Shanley | 623/1.15 |
| 6,562,065 | B1 * | 5/2003 | Shanley | 623/1.15 |
| 6,799,637 | B1 * | 10/2004 | Schetky et al. | 166/384 |
| 2002/0046840 | A1 | 4/2002 | Schetky et al. | |
| 2002/0107562 | A1 * | 8/2002 | Hart et al. | 623/1.15 |

OTHER PUBLICATIONS

Communication from U.S. District Court Transferring Case, Memry Corporation v. Kentucky Oil Technology, N.V., Case No. H–04–1959 (S.D. Tex.), dated Sep. 7, 2004 (1 page).

Plaintiffs Original Complaint, Memry Corporation v. Kentucky Oil Technology, N.V., Case No. H–04–1959, (S.D. Tex.), filed May 14, 2004 (20 pages).

Defendants Motions (1) to Dismiss the Complaint for Insufficiency of Process and Lack of Personal Jurisdiction, (2) to Dismiss Counts I–III of the Complaint for Failure to State a Claim, and (3) in the Alternative, to Transfer This Action to the Federal District Court for the Northern District of California, Memry Corporation v. Kentucky Oil Technology, N.V., Case No. H–04–1959, (S.D. Tex.), filed Jul. 7, 2004 (49 pages).

Plaintiff's First Amended Complaint, Memry Corporation v. Kentucky Oil Technology, N.V., Case No. C–04–03843, (N.D. Cal.), filed Aug. 19, 2004 (20 pages).

Answer of Defendants and Counterclaims of Kentucky Oil Technology N.V. Against Memry Corporation and Schlumberger Technology Corporation, Memry Corporation v. Kentucky Oil Technology, N.V., Case No. C–04–03843, (N.D. Cal.) filed Nov. 2, 2004 (20 pages).

Plaintiff and Counterdefendants Memry Corporation's Answer to Kentucky Oil Technology N.V.'s Counterclaims and Demand for Jury Trial, Memry Corporation v. Kentucky Oil Technology, N.V., Case No. C–04–03843, (N.D. Cal.), filed Dec. 3, 2004 (10 pages).

Schlumberger Technology Corporation's Notice of Motion and Motion to Dismiss Kentucky Oil Technology's Third, Fourth, Fifth, and Sixth Counterclaims; and Memorandum of Points and Authorities, Memry Corporation v. Kentucky Oil Technology, N.V., Case No. C–04–03843, (N.D. Cal.), filed Jan. 24, 2005 (32 pages).

[Proposed] Order Granting Schlumberger Technology Corporation's Motion to Dismiss Kentucky Oil Technology's Third, Fourth, Fifth, and Sixth Counterclaims, Memry Corporation v. Kentucky Oil Technology, N.V., Case No. C–04–03843, (N.D. Cal.), filed Jan. 24, 2005 (3 pages).

First Amended Counterclaims of Kentucky Oil Technology N.V. Against Memry Corporation and Schlumberger Technology Corporation, Memry Corporation v. Kentucky Oil Technology, N.V., Case No. C–04–03843, (N.D. Cal.), filed Feb. 9, 2005 (16 pages).

Schlumberger Technology Corporation's Notice of Motion and Motion to Dismiss Kentucky Oil Technology's First Amended Third, Fourth, Fifth, and Sixth Counterclaims; and Memorandum of Points and Authorities, Memry Corporation v. Kentucky Oil Technology, N.V., Case No. C–04–03843, (N.D. Cal.), filed Feb. 24, 2005 (32 pages).

Request for Judical Notice in Support of Schlumberger Technology Corporation's Motion to Dismiss Kentucky Oil Technology's First Amended Third, Fourth, Fifth, and Sixth Counterclaims, Memry Corporation v. Kentucky Oil Technology, N.V., Case No. C–04–03843, (N.D. Cal.), filed Feb. 24, 2005 (3 pages).

[Proposed] Order Granting Schlumberger Technology Corporation's Motion to Dismiss Kentucky Oil Technology's First Amended Third, Fourth, Fifth, and Sixth Counterclaims, Memry Corporation v. Kentucky Oil Technology, N.V., Case No. C–04–03843, (N.D. Cal.), filed Feb. 24, 2005 (3 pages).

Plaintiff and Counterdefendant Memry Corporation's Notice of Motion and Motion to Dismiss Kentucky Oil Technology's Third, Fourth, Fifth, and Sixth Counterclaims; and Memorandum of Points and Authorities, Memry Corporation v. Kentucky Oil Technology, N.V., Case No. C–04–03843, (N.D. Cal.), filed Feb. 25, 2005 (29 pages).

Request for Judical Notice in Support of Memry Corporation's Motion to Dismiss Kentucky Oil Technology's Third, Fourth, Fifth, and Sixth Counterclaims, Memry Corporation v. Kentucky Oil Technology, N.V., Case No. C–04–03843, (N.D. Cal.), filed Feb. 25, 2005 ( 3 pages).

[Proposed] Order Granting Memry Corporation's Motion to Dismiss Kentucky Oil Technology's Third Fourth, Fifth, and Sixth Counterclaims, Memry Corporation v. Kentucky Oil Technology, N.V., Case No. C–04–03843, (N.D. Cal.), filed Feb. 25, 2005 (3 pages).

Opposition of Kentucky Oil to Motions of Memry Corporation and Schlumberger Technology Corporation to Dismiss First Amended Counterclaims, Memry Corporation v. Kentucky Oil Technology, N.V., Case No. C–04–03843, (N.D. Cal.), filed Mar. 11, 2005 (29 pages).

Kentucky Oil's Opposition to Counterdefendants Requests for Judical Notice in Support of Their Motions to Dismiss Kentucky Oil Technology's First Amended Third, Fourth, Fifth, and Sixth Counterclaims, Memry Corporation v. Kentucky Oil Technology, N.V., Case No. C–04–03843, (N.D. Cal.), filed Mar. 11, 2005 (3 pages).

Plaintiff and Counterdefendant Memry Corporation's Reply in Support of Motion to Dismiss Kentucky Oil Technology's Third, Fourth, Fifth, and Sixth Counterclaims, Memry Corporation v. Kentucky Oil Technology, N.V., Case No. C–04–03843, (N.D. Cal.), filed Mar. 18, 2005 (9 pages).

Plaintiff and Counterdefendant Memry Corporation's Reply in Support of Request for Judical Notice, Memry Corporation v. Kentucky Oil Technology, N.V., Case No. C–04–03843, (N.D. Cal). filed Mar. 18, 2005 (4 pages).

Reply of Schlumberger Technology Corporation to Kentucky Oil Technology's Opposition to First Amended, Third, Fourth, Fifth, and Sixth Counterclaims, Memry Corporation v. Kentucky Oil Technology, N.V., Case No. C–04–03843, (N.D. Cal.), filed Mar. 18, 2005 (17 pages).

Schlumberger's Response to Kentucky Oil's Opposition to Counterdefendants Requests for Judical Notice, Memry Corporation v. Kentucky Oil Technology, N.V., Case No. C–04–03843, (N.D. Cal.), filed Mar. 18, 2005 (3 pages).

Schlumberger's Notice of Motion and Motion to Strike Exhibits 1, 2, and 4 to the Declaration of Notice A. Pisano, Memry Corporation v. Kentucky Oil Technology, N.V., Case No. C–04–03843, (N.D. Cal.), filed Mar. 18, 2005 ( 3 pages).

Kentucky Oil's Opposition to STC's Motion to Strike Exhibits 1, 3 and 4 to the Declaration of Nicola A. Pisano, Memry Corporation v. Kentucky Oil Technology, N.V., Case No. C–04–03843, (N.D. Cal.), filed Mar. 25, 2005 (3 pages).
Kentucky Oil's Notice of Motion and Motion to Strike Declaration of Benjamin Holl and Portions of Counterdefendants Reply Briefs, Memry Corporation v. Kentucky Oil Technology, N.V., Case No. C–04–03843, (N.D. Cal.), filed Mar. 25, 2005 (4 pages).
[Proposed] Order Granting Kentucky Oil's Motion to Strike Declaration of Benjamin Holl and Portions of Counterdefendants Reply Briefs, Memry Corporation v. Kentucky Oil Technology, N.V., Case No. C–04–03843, (N.D. Cal.), entered Mar. 25, 2005 (2 pages).
Order Granting in Part and Denying in Part Counterdefendants Motion to Dismiss, Memry Corporation v. Kentucky Oil Technology, N.V., Case No. C–04–03843, (N.D. Cal.), entered Apr. 8, 2005 (26 pages).
Plaintiff and Counterdefendant Memry Corporation's Reply to Kentucky Oil Technology N.V.'s Counterclaims and Demand for Jury Trial, Memry Corporation v. Kentucky Oil Technology, N.V., Case No. C–04–03843, (N.D. Cal.), filed Apr. 18, 2005 ( 8 pages).
Second Amended Counterclaims of Kentucky Oil Technology N.V. Against Memry Corporation and Schlumberger Technology Corporation, Memry Corporation v. Kentucky Oil Technology, N.V., Case No. C–04–03843, (N.D. Cal.), filed May 6, 2005 (20 pages).
Plaintiff Memry Corporation's Reply to Kentucky Oil Technology N.V.'s Second Amended Counterclaims and Demand for Jury Trial, Memry Corporation v. Kentucky Oil Technology, N.V., Case No. C–04–03843, (N.D. Cal.), filed Jun. 3, 2005 (9 pages).
Schlumberger Technology Corporation's Notice of Motion and Motion to Dismiss the Fourth, Fifth, Sixth, Seventh and Eighth Counterclaims in Kentucky Oil Technology's Second Amended Counterclaims, Memry Corporation v. Kentucky Oil Technology, N.V., Case No. C–04–03843, (N.D. Cal.), filed Jun. 3, 2005 (18 pages).
Opposition of Kentucky Oil Technology to Schlumberger Technology Corporation's Motion to Dismiss Kentucky Oil's Second Amended Counterclaims, Memry Corporation v. Kentucky Oil Technology, N.V., Case No. C–04–03843, (N.D. Cal.), filed Jun. 17, 2005 (16 pages).
Schlumberger Technology Corporation's Reply Brief in Support of its Motion to Dismiss the Fourth, Fifth, Sixth, Seventh and Eighth Counterclaims in Kentucky Oil Technology's Second Amended Counterclaims, Memry Corporation v. Kentucky Oil Technology, N.V., Case No. C–04–03843, (N.D. Cal.), filed Jun. 24, 2005 (11 pages).
Order Granting in Part and Denying in Part STC's Motion to Dismiss, Memry Corporation v. Kentucky Oil Technology, N.V., Case No. C–04–03843, (N.D. Cal.), entered Jul. 4, 2005 (8 pages).
Schlumberger Technology Corporation's Answer to Kentucky Oil Technology's Second Amended Counterclaims, Memry Corporation v. Kentucky Oil Technology, N.V., Case No. C–04–03843, (N.D. Cal.), filed Jul. 28, 2005 (8 pages).
Notice o Motion and Motion by Kentucky Oil to Compel Production of Documents by Schlumberger Technology Corporation Pursuant to Fed. R. Civ. Rule 37; Memorandum of Points and Authorities in Support Thereof; Declaration of Michael Bierman, Memry Corporation v. Kentucky Oil Technology, N.V., Case No. C–04–03843, (N.D. Cal.), filed Jul. 28, 1005 (32 pages).
Schlumberger Technology Corporation's Opposition to Kentucky Oil Technology's Motion to Compel, Memry Corporation v. Kentucky Oil Technology, N.V., Case No. C–04–03843, (N.D. Cal.), filed Aug. 4, 2005 (21 pages).
Declaration of David B. Moyer in Support of Schlumberger Technology Corporation's Opposition to Kentucky Oil Technology's Motion to Compel, Memry Corporation v. Kentucky Oil Technology, N.V., Case No. C–04–03843, (N.D. Cal.), filed Aug. 4, 2005 (52 pages).
Kentucky Oil's Reply in Support of Motion to Compel, Memry Corporation v. Kentucky Oil Technology, N.V., Case No. C–04–03843, (N.D. Cal.), filed Aug. 10, 2005 (18 pages).
Declaration of Nicola A. Pisano in Support of Kentucky Oil's Motion to Compel, Memry Corporation v. Kentucky Oil Technology, N.V., Case No. C–04–03843, (N.D. Cal.), filed Aug. 10, 2005 (69 pages).
Order Granting Kentucky Oil's Motion to Compel Production of Documents, Memry Corporation v. Kentucky Oil Technology, N.V., Case No. C–04–03843, (N.D. Cal), entered Aug. 17, 2005 (8 pages).

* cited by examiner

EXPANDABLE DEVICES AND METHOD

CROSS REFERENCE TO RELATED APPLICATIONS

The following is based on and claims priority to provisional application No. 60/385,778 filed Aug. 6, 2002.

FIELD OF THE INVENTION

The present technique relates to the field of expandable devices and methods. More particularly, the technique comprises an expandable device and a method related to an expandable device that has reduced axial shrinkage during radial deformation or expansion thereof.

BACKGROUND OF THE INVENTION

In the production of sub-terrain fluids, such as oils or natural gas, a variety of expandable devices have been used to cultivate wellbore environments. For example, generally tubular devices, such as expandable liners, expandable sandscreens, well linings and well patches have been employed. These devices may be expandable devices which, under the proper stimuli, transition from a collapsed (small diameter) configuration to an expanded (large diameter) configuration. In many instances, expandable devices comprise a plurality of longitudinal slots or openings that increase in size as the device is expanded (U.S. Pat. Nos. 5,366,012 and 5,667,011). These openings, if so desired, may be configured to permit the flow of desirable production fluids into the interior of the wellbore while simultaneously preventing the ingress of contaminants, such as sand.

Expandable devices are typically deployed downhole into the wellbore, while in their respective collapsed configurations. In other words, the diameter of the collapsed expandable device is less than that of the wellbore and, as such, the expandable device feeds easily into the wellbore. Once the expandable device is lowered to a desired location within the wellbore, a radial expansion force is applied to drive the device to an expanded configuration. Accordingly, the device may better conform to the interior surface of the wellbore.

If so desired, expandable devices may be coupled to form a conduit that extends for great distances below the Earth's surface. Indeed, wellbores may extend thousands of feet below the Earth's surface to reach production fluids disposed in subterranean geological formations commonly know as "reservoirs".

In many traditional systems (U.S. Pat. Nos. 5,366,012 and 5,667,011), however, an increase in the radial dimension of the device induces a decrease in the axial dimension thereof. In other words, as the device diameter increases, the device length decreases. Accordingly, it may be more difficult to properly position the device into the wellbore. Moreover, a change in axial length may lead to separation or damage of already coupled devices.

The present invention is directed to overcoming, or at least reducing the effects of one or more of the problems set forth above, and can be useful in other applications as well.

SUMMARY OF THE INVENTION

In one embodiment of the present technique, an expandable device comprises a tubular having a plurality of slots therein. The tubular is configured to expand from a first diameter to a second diameter such that the axial length of the tubular remains substantially constant.

According to an alternate embodiment of the present technique, a device comprising a device segment having a plurality of slots disposed therein is provided. In this alternate embodiment, the slots define first and second members coupled to one another, wherein at least one of the first and second members is adapted to substantially retard axial contraction of the device upon radial expansion of the device.

According to yet another embodiment of the present technique, a system for producing wellbore fluids is provided. In this embodiment, the system comprises a wellbore, a device, and an expansion mechanism for expanding the device from a collapsed configuration to an expanded configuration. Moreover, the device comprises an expansion compensation portion, wherein the expansion compensation portion is adapted to retard axial contraction of the device upon radial expansion thereof.

According to yet another embodiment of the present technique, a method for deploying an expandable device into a wellbore is provided. The method comprises inserting a device, the device being in a collapsed configuration, into a wellbore. The method further comprises expanding the device to an expanded configuration such that the axial length of the device remains substantially constant.

In another embodiment of the present technique, a method for forming an expandable device is provided. The method comprises cutting a pattern of slots into a segment of the device, wherein each pattern of slots comprises an axial contraction compensation portion.

BRIEF DESCRIPTION OF THE DRAWINGS

The invention will hereafter be described with reference to the accompanying drawings, wherein like reference numerals denote like elements, and.

DETAILED DESCRIPTION

Figure 1:
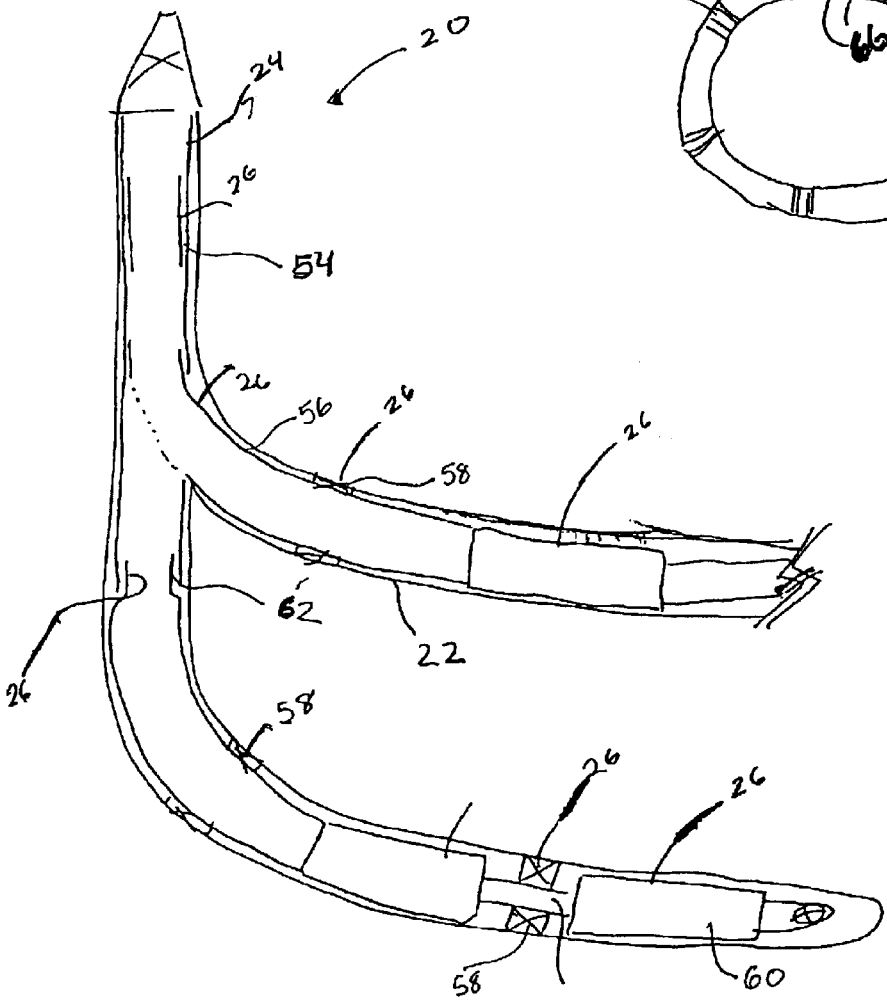
FIG. 1 is a depiction of a wellbore having a plurality of exemplary expandable devices disposed therein.

Referring generally to FIG. 1, an exemplary wellbore environment is illustrated. For example, FIG. 1 illustrates a wellbore 20 having at least one lateral branch section 22.

The wellbore 20 may be drilled into the surface of the Earth to facilitate removal of production fluids (i.e. natural gas, oil, etc.) therefrom. In operation, production fluids may enter from the "reservoir" into the wellbore 20. Subsequently, by employing traditional production methods well known to the skilled artisan, the production fluids may be retrieved to the Earth's surface.

Disposed along the interior surface of the wellbore 20 may be a casing 24. The casing 24 may provide structural integrity to the wellbore 20 and can be cemented into location if so desired. Indeed, the casing 24 may extend for thousands of feet into the wellbore 20 as well as into the lateral branch sections 22.

At least one expandable device 26 also is disposed within the wellbore 20. As further discussed below, devices 26 may comprise, casing patches, expandable packers, expandable hangers, expandable liners, expandable casings 24, expandable sandscreens or expandable control line conduits (i.e. conduits for fiber optic lines, electric lines, hydraulic lines, etc.). As is also further discussed below, devices 26 may be inserted into the wellbore in a collapsed configuration and subsequently expanded. By inserting devices 26 into the wellbore 20 in a collapsed state, a number of advantages may be achieved over traditional systems. For example, a device 26 in the collapsed state may have a diameter less than that of the wellbore it is to be inserted into, and, as such, require less effort for downhole insertion.

Figure 2:
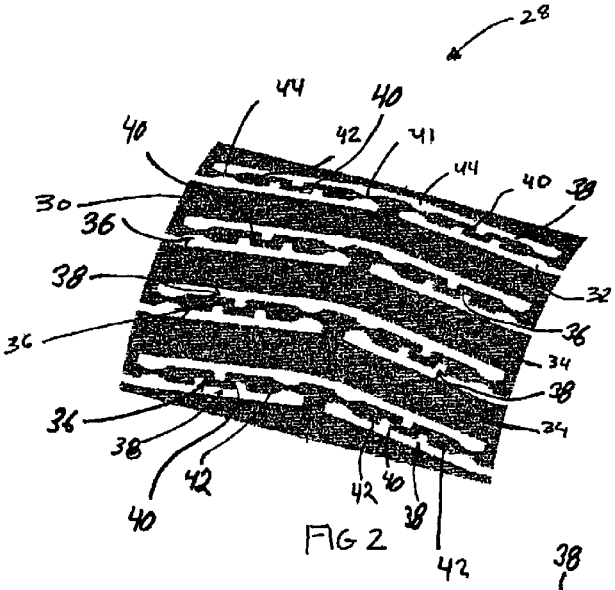
FIG. 2 is a depiction of a portion of an embodiment of an expandable device.

Referring next to FIG. 2, a section 28 of an expandable device 26 (FIG. 1) is illustrated. The device 26 comprises a wall 30 having a plurality of slots 32 disposed therein. Although the embodiment is illustrated as having slots 32 disposed in the wellbore, the present technique may also be employed with thinned or weakened areas in lieu of the slots 32. In this embodiment, slots 32 define thick and thin struts 34 and 36, respectively. The thick and thin struts 34 and 36 may include various expansion compensation portions 38, the compensation portions 38 being adapted to prevent axial contraction of the device 26 upon radial expansion thereof.

For example, the compensation portions 38 may comprise spring segments 40 that facilitate axial expansion of the appropriate strut members 36. Thus, during radial expansion of the device 26, the spring segment 40 may flex, thereby allowing the strut member 36 upon which it is integrated, to contract or expand as necessary. In other words, the spring segment 40 changes length axially during device expansion, thereby enabling the device 26, as a whole, to radially expand without substantial axial contraction thereof. In some embodiments, the spring segment 40 may undergo both elastic deformation as well as plastic deformation.

Under expansion loads, relatively thick struts 34 remain essentially undeformed and, as such, maintain the overall axial length of the device 26. Contemporaneously, however, the expansion loads applied to the thin members 36 induce axial contraction lengthening thereof, thereby facilitating radial expansion of the device 26. Moreover, the spring segments 40 may also provide additional flexibility to the device 26 thereby reducing the expansion forces necessary to drive device 26 to its expanded configuration.

Additionally, compensation portions 38 may comprise rotational segments 42 disposed along respective strut members 36. Rotational segments 42 also substantially reduce axial contraction of the device 26 (FIG. 1), as a whole, upon radial expansion thereof. Indeed, during expansion, the exemplary rotational segments 42, as well as the relatively thin strut 36 within which it is disposed, tend to rotate whereas the relatively thick struts 34 retain their original configuration. This torsional deformation of the thin struts 36, being either plastic or elastic, allows the device 26 to radially expand while the rigid thick struts 34 substantially maintain the original axial length of device 26. The rotational segments 42 may have tapering portions, rounded portions or other variations in the thickness of the strut 36 to optimize the properties of the rotational segments 42.

Disposed between adjacent, relatively, thick and thin struts 34 and 36 may be hinge portions 44. In the exemplary embodiment, hinge portions 44 facilitate the pivotal movement of the strut members 34 and 36 with respect to one another. The hinge portions 44 may be thinned sections of wall 30 disposed at the intersection of the respective ends of the struts 34 and 36. The thinner hinge portions 44 reduce the overall expansion force required to drive the exemplary device from a collapsed to an expanded configuration.

Various features of the expandable device 26, such as the strut members 34 and 36, compensation portions 38 as well as the corresponding slots 32 may be formed by a number of processes. For example, these features may be formed by targeting a high-pressure water jet stream against the stock material from which the device 26 is to be formed. The water pressure carves out desired features on to the device. In a similar vein, these features may be carved by laser-jet cutting the stock material. Additionally, the features may be formed by a stamping process. In this process, the flat stock material is placed into a press which then stamps the features into the material. Once stamped, the material may be rolled into a rounded or tubular form. To ensure structural integrity of the stamped material, the features may be at least as wide as the thickness of the material being stamped.

Figure 3A:
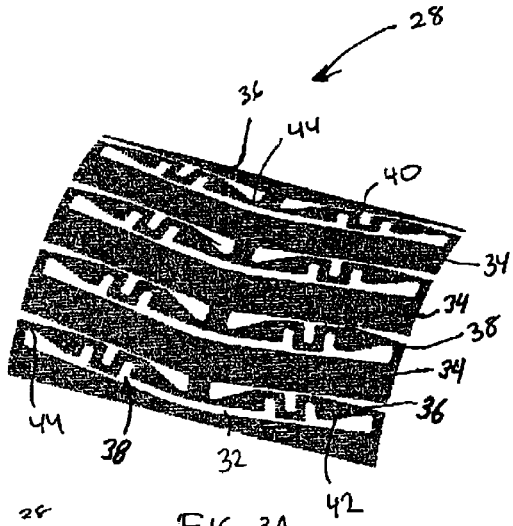
FIG. 3A is a depiction of a portion of an embodiment of an expandable device in a collapsed configuration.
Figure 3B:
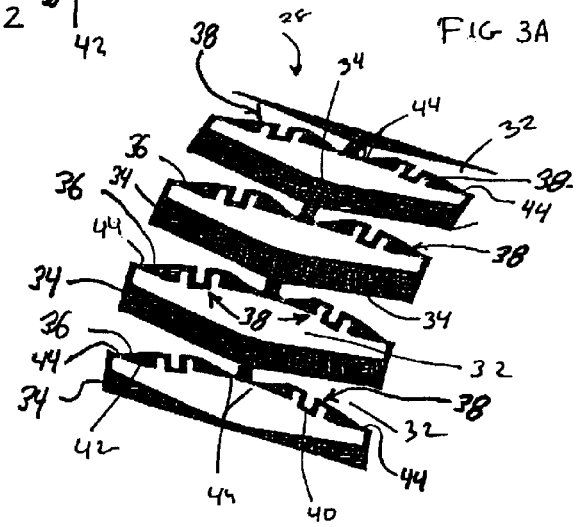
FIG. 3B illustrates the device of FIG. 3A in an expanded configuration.

Referring next to FIGS. 3A and 3B, an alternate embodiment of the present technique is illustrated. Particularly, FIGS. 3A and 3B illustrate one embodiment of section 28 of device 26 in the collapsed configuration and expanded configuration respectively. Section 28 comprises compensation portions 38, such as spring segments 40 and rotational segments 42. Again, as the device 26 is taken from the collapsed to expanded configuration, the expansion forces may induce deformation of the thin strut 36. However, the relatively thick strut 34, because of its size, resists deformation. Accordingly, the thin struts 36 facilitate radial expansion of the device while the thick struts 34, concurrently, maintain the axial length of the device 26.

Figure 4A:
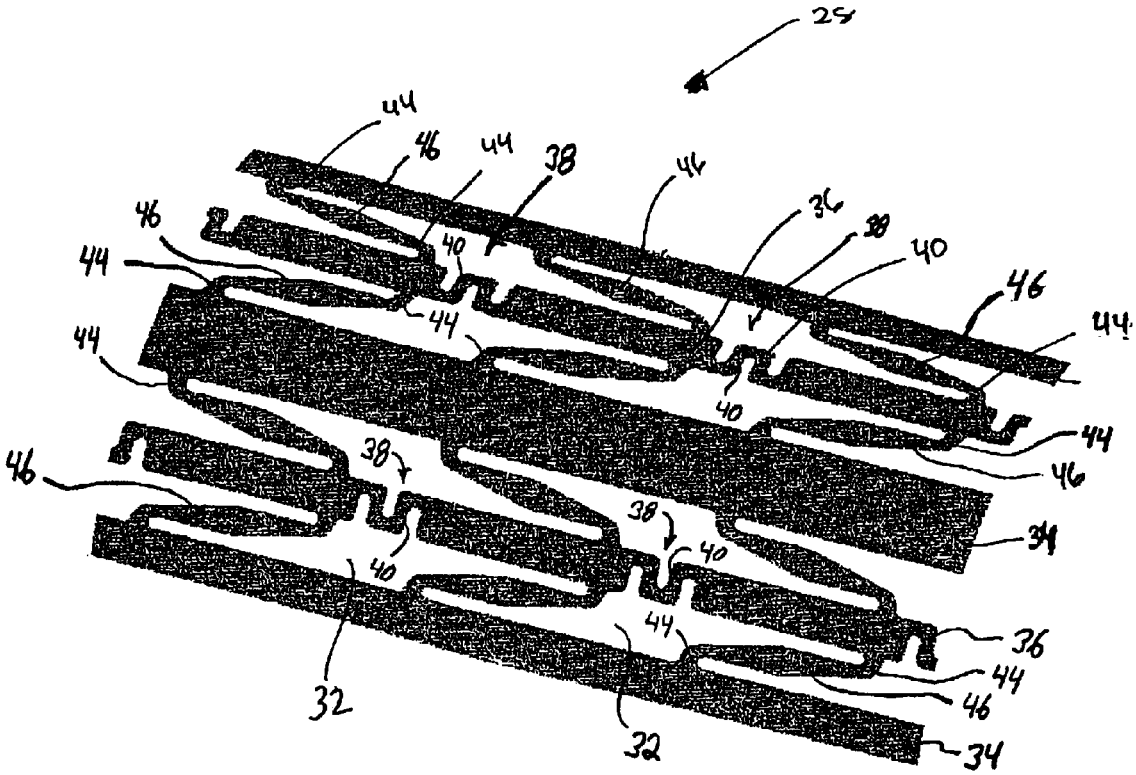
FIG. 4A is a depiction of a portion of another embodiment of an expandable device in a collapsed configuration.
Figure 4B:
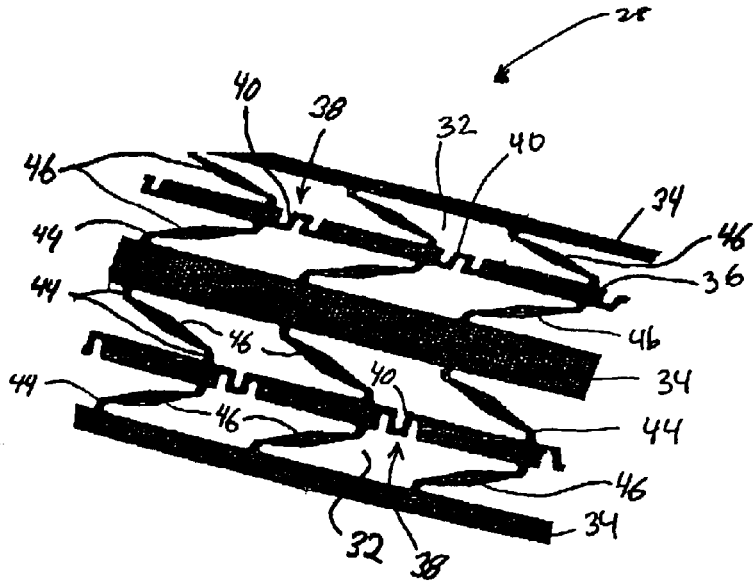
FIG. 4B illustrates the device of FIG. 4A in an expanded configuration.

Referring next to FIGS. 4A and 4B, another embodiment of the present technique is illustrated. In the collapsed state, as illustrated in FIG. 4A, section 28 comprises thick and thin struts 34 and 36, respectively, traversed by a linking member 46. The linking member is connected to the respective struts 34 and 36 by hinge portions 44. The linking member 46, in conjunction with the thin and thick struts 34 and 36, respectively may define parallelogramic slots 32.

During radial expansion of device 26 to the expanded configuration illustrated in FIG. 4B, the linking member 46 pivots about hinge portions 44. The linking members 46 may pivot such that the thick and thin struts 34 and 36 remain parallel to one another. Additionally, similar to the above embodiments, compensation portions 38 facilitate radial expansion of the device while concurrently maintaining the overall length of the device. In the exemplary embodiment, the spring segments 40 may deform thereby facilitating radial expansion of the device without substantially affecting axial length. Moreover, the linking members 46 may be configured to elastically or plastically deform, thereby assisting in the radial expansion of the device 26.

Figure 5:
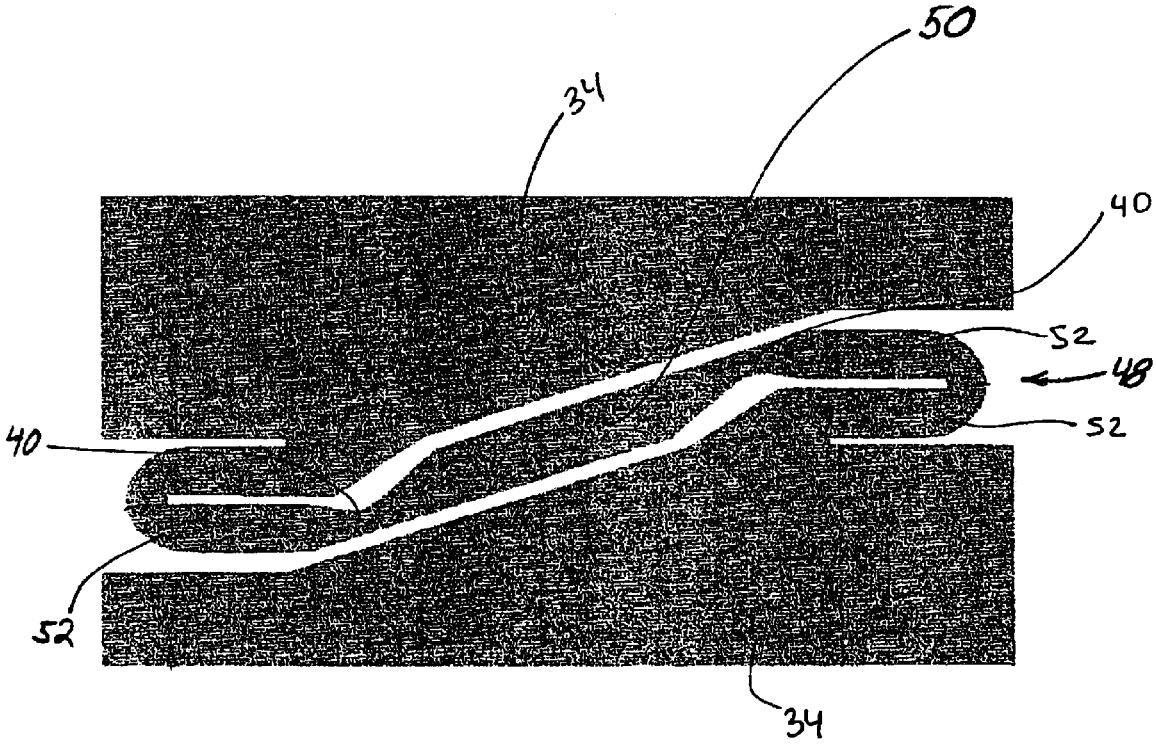
FIG. 5 is an illustration of an embodiment of a cell of an expandable device, the cell being in the collapsed configuration.

Referring next to FIG. 5, an expandable cell 48 of an expansion section 28 in a collapsed configuration is illustrated. In this embodiment, a relatively thin bending connector 50 traverses adjacent thick struts 34. The bending connector 50 may comprise folding portions 52 and spring segments 40. During radial expansion, the thick struts 34 distance themselves from one another, and resultantly, the folding portions 52 begin to unfold. As the radial expansion continues, bending connector 50 may undergo axial deformation. Indeed, the spring segments 40 of the bending connector 50 may undergo elastic or plastic deformation to facilitate the radial expansion of the device 26 without axial contraction thereof. The bending connector 50 maintains the thick struts 34 generally parallel to one another during the expansion process.

Figure 6A:
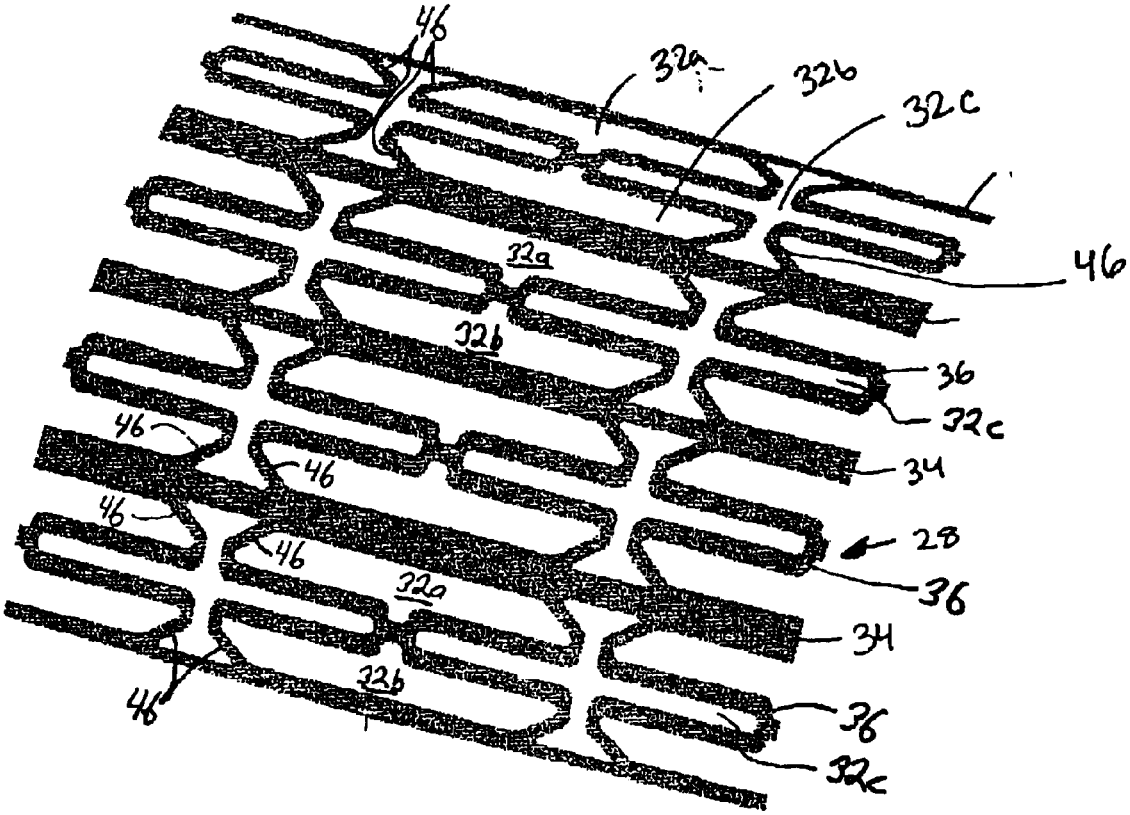
FIG. 6A is a depiction of a portion of another embodiment of an expandable device in a collapsed configuration.
Figure 6B:
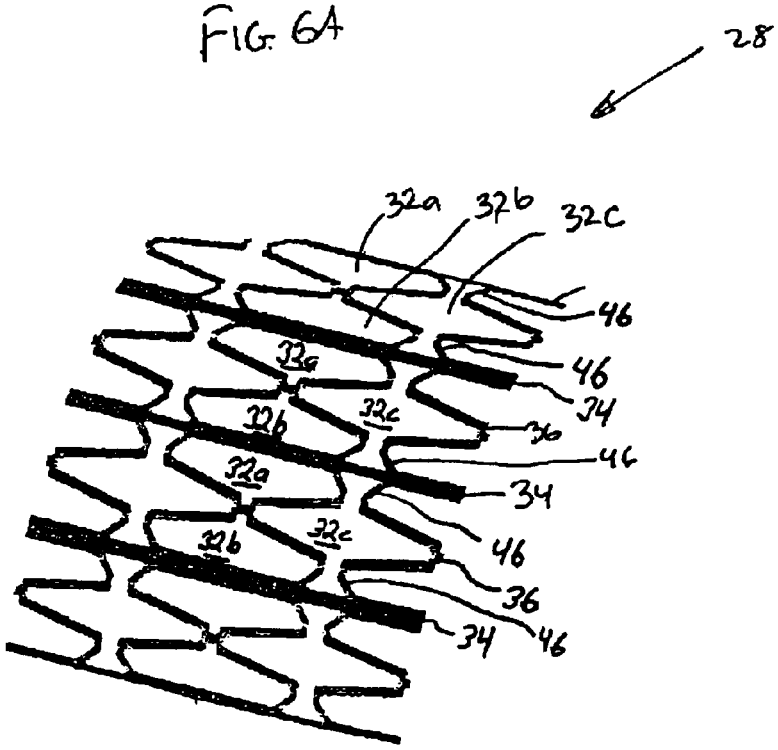
FIG. 6B illustrates the device of FIG. 6A in an expanded configuration.
Figure 7:
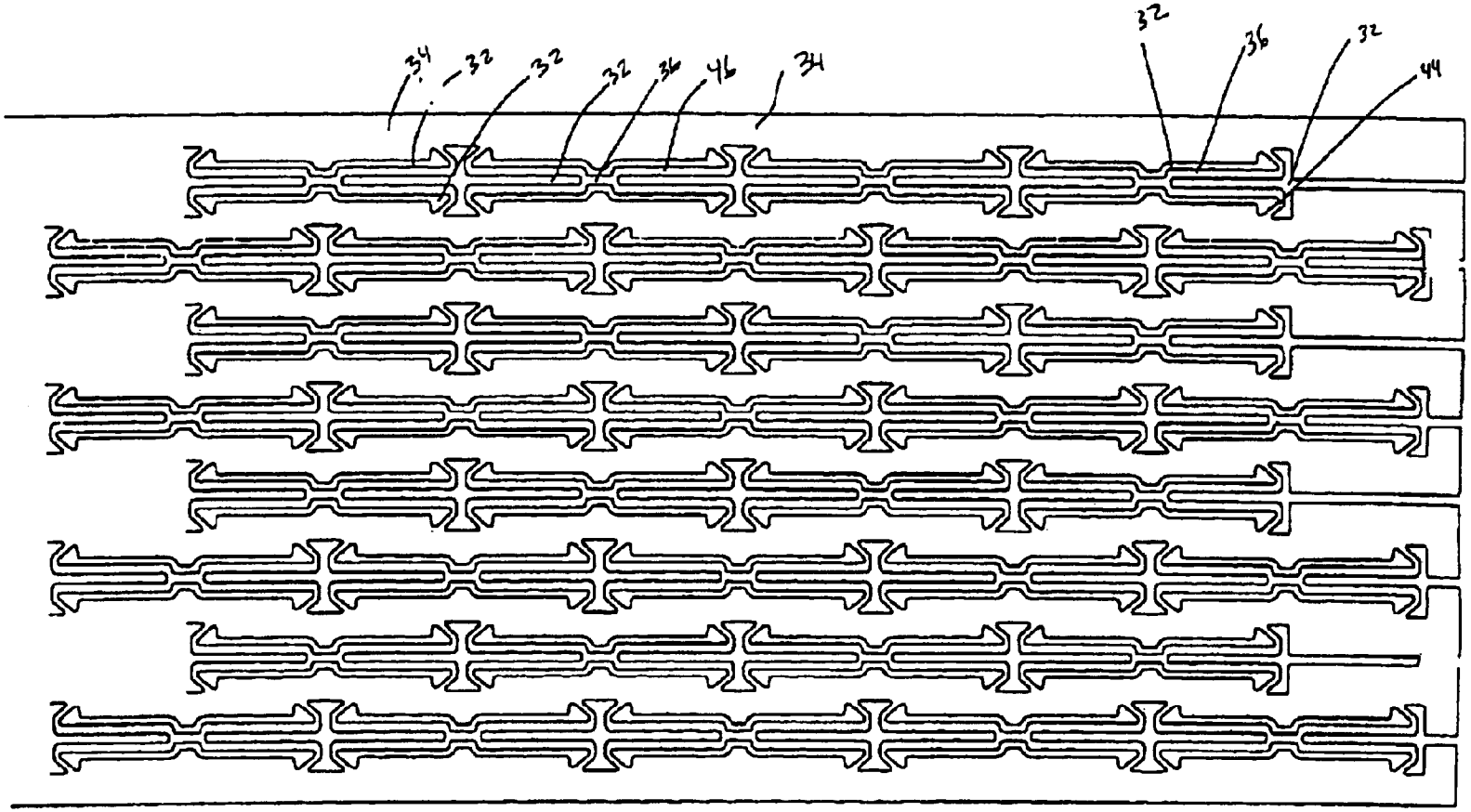
FIG. 7 is a flattened elevational view of an embodiment of an expandable device having a certain pattern of slots.

Referring next to FIGS. 6A and 6B, another embodiment of the present device is illustrated in collapsed and expanded configurations, respectively. In this embodiment, section 28 comprises a series of linking members 46 and thin struts 36 which, in combination, define three separate slot shapes 32*a*, 32*b*, and 32*c*. The linking members 46 as well as the thin struts 36 may comprise spring portions as well as rotation portions, e.g. spring portions 40 and rotation portions 42. Spring portions 40 and rotation portions 42 serve as expansion compensators radial expansion of the device to prevent shortening the original axial length of device 26. Referring to FIG. 7, the slot pattern of FIGS. 6A and 6B is illustrated as a flat sheet. Advantageously, tubulars may be formed from flat sheets which are subsequently bent into a cylindrical shape.

Returning to FIG. 1, the present technique may be employed in many types of devices 26 employable within a wellbore 20. For example, the device 26 may be a casing patch 54. If, for illustrative purposes, a hole were to develop in the casing 24, the structural integrity of the casing 24 may be affected. Accordingly, a casing patch 54 may be deployed to the location of the hole in the collapsed configuration. Subsequently, the casing patch 54 may be expanded to secure the casing patch 54 to the damaged portion of the original casing 24. The device may also comprise an expandable liner 56 for the multilateral junctions. Again, the liner 56 may be deployed to the desired location and subsequently expanded for securing at such location. The device 26 may also comprise an expandable packer 58 deployed, for example, to isolate portions of a wellbore 20. In operation, the packer 58, similar to other expandable devices described herein, may be deployed to a desired location and subsequently expanded. Yet another embodiment of device 26 is an expandable sand-screen 60. Sand-screens 60 may be placed into the wellbore 20 to prevent the ingress of sand from the interior wellbore surface while concurrently permitting the ingress of desirable production fluids. Lastly, although not exhaustively, the device 26 may comprise an expandable hanger 62. In operation, the expandable hanger 62 facilities, for example, the coupling of casing or lining segments together. Indeed, the hanger 62 may allow casings or linings to extend for hundreds of feet into the wellbore. Again, each of the exemplary devices 26 discussed above may be formed, at least in part, of the expandable devices of the present technique.

Figure 8:
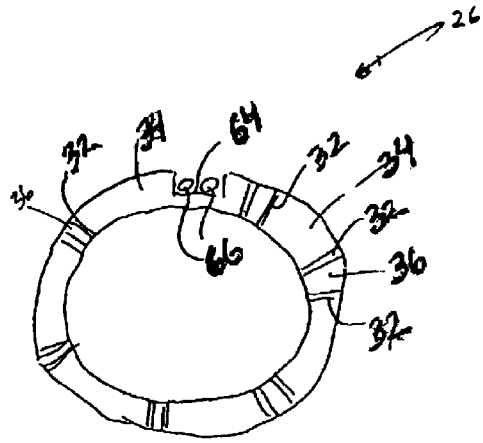
FIG. 8 is a cross-sectional view of an expandable device having a cutout portion.

Referring to FIG. 8, a cross-sectional view of an expandable device 26 having a cutout portion 64 is illustrated. The cutout portion 64 may be employed as a passageway for the routing of control lines 66 therethrough. Additionally, intelligent completions equipment, monitoring devices, fiber optic lines and other equipment may be positioned in the cutout portion 64. As illustrated, cutout portion 64 lies in a generally axial direction along the exterior of device 26, although the cutout can be formed along an interior surface or entirely within the wall of device 26.

Figure 9:
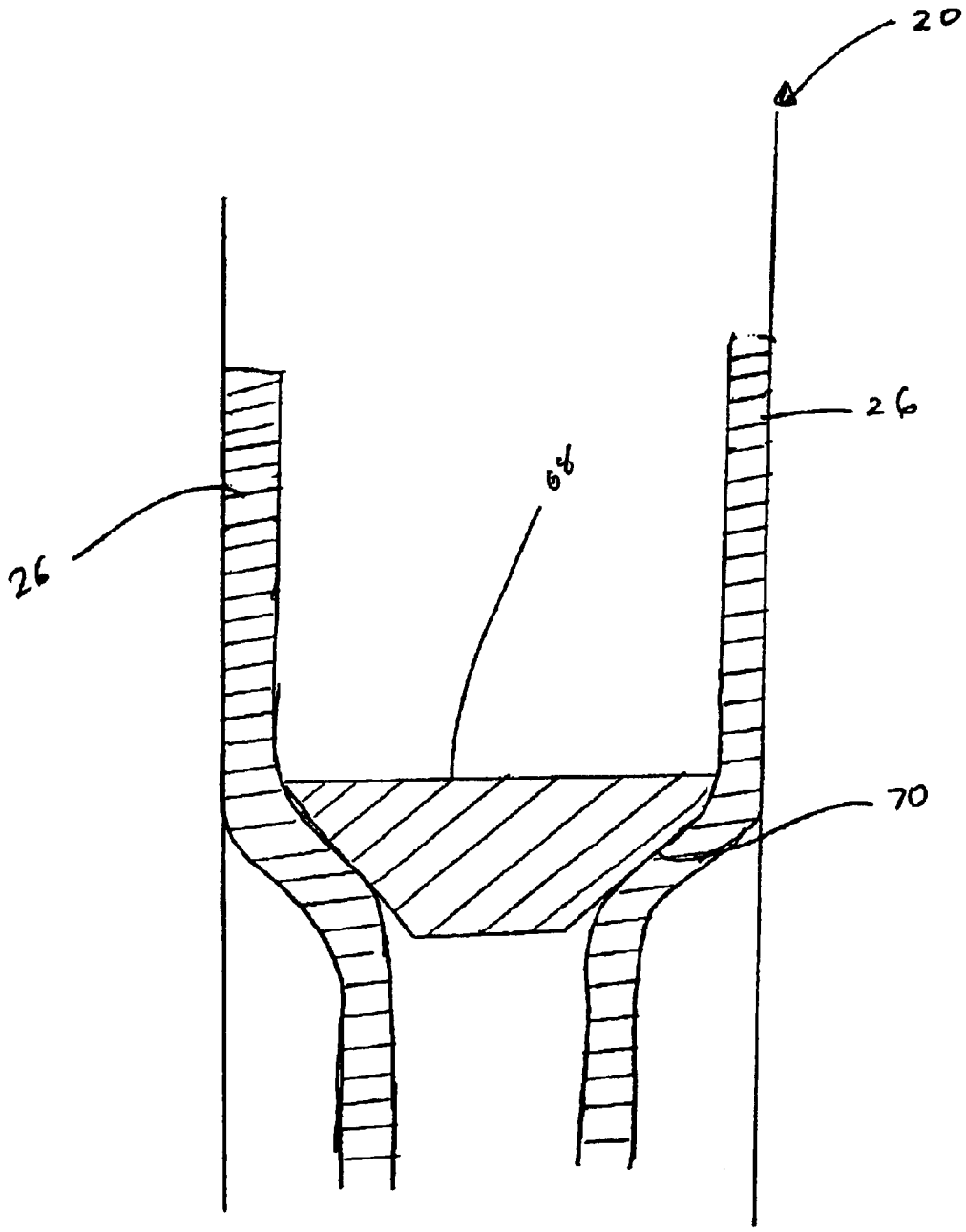
FIG. 9 is a depiction of a wellbore having an embodiment of an expandable device disposed therein with an expansion mechanism for expanding the device.

Referring to FIG. 9, a cone 68 is illustrated as expanding the device 26. A variety of expansion devices may be employed and cone 68 is just one option. Once the expandable device 26 has been placed at the appropriate position in the wellbore, cone 68 is then pulled or pushed therethrough. A tapered end 70 of cone 68 may easily be fed into the device 26 when in its collapsed configuration. As the cone 68 progresses further, the widening diameter of the cone abuts against the interior surface of the device and imparts the necessary radial forces for expansion.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims. Indeed, the present technique may be employed in any number of oilfield applications such as umbilical or conduit repairs for example.

What is claimed is:

1. An expandable device for use in a wellbore, comprising:

a tubular configured for deployment in a wellbore application, the tubular having a plurality of slots therein, the plurality of slots being configured to enable expansion of the tubular from a first diameter to a second diameter, wherein the tubular comprises a plurality of expansion compensation portions adapted to substantially retard axial contraction of the tubular during radial expansion of the tubular from the first diameter to the second diameter, wherein the expansion compensation portions undergo changes in axial length to enable the radial expansion of the tubular.

2. The device as recited in claim 1, wherein the device comprises a sand-screen.

3. The device as recited in claim 1, wherein the tubular is configured to receive control lines.

4. The device as recited in claim 1, wherein the plurality of slots comprise a first slot pattern and a second slot pattern, wherein the slot patterns define the expansion compensation portions.

5. The device as recited in claim 1, wherein the slots define thick and thin struts respectively.

6. The device as recited in claim 1, wherein the expansion compensation portion defines a spring portion that undergoes the change in axial length.

7. The device as recited in claim 1, wherein the slots generally present a parallelogramic shape.

8. An expandable device for use in a wellbore, comprising:

a tubular configured for deployment in a wellbore application, the tubular having a plurality of slots therein, the plurality of slots being configured to enable expansion of the tubular from a first diameter to a second diameter, wherein the tubular comprises a plurality of expansion compensation portions adapted to substantially retard axial contraction of the tubular during radial expansion of the tubular from the first diameter to the second diameter, wherein the expansion compensation portion defines a rotational segment.

9. An expandable device, comprising:

a wellbore device comprising an expansion section having a plurality of slots disposed therein, wherein each slot outlines a plurality of first members coupled to a plurality of second members;

wherein at least one of the first and second members is adapted to substantially retard axial contraction of the device upon radial expansion of the device, further wherein at least one of the first and the second members comprises a rotational segment.

10. The expandable device as recited in claim 9, further comprising at least one hinge portion coupling the plurality of first members and the plurality of second members.

11. The expandable device as recited in claim 9, wherein at least one of the first and the second members comprises a plastically deformable portion, wherein the plastically deformable portion axially deforms, thereby substantially retarding axial contraction of the device during radial expansion thereof.

12. The expandable device as recited in claim 9, wherein at least one of the first and the second members comprises a spring portion.

13. The expandable device as recited in claim 9, wherein the first members are thicker than the second members.

14. The expandable device as recited in claim 9, wherein the plurality of slots comprise a first slot pattern and a second slot pattern.

15. A system for production of wellbore fluids, comprising:

a wellbore;

a device having a plurality of slots disposed therein, the device further having a collapsed configuration and an expanded configuration, wherein the diameter of the device in the collapsed configuration is less than the diameter of the wellbore;

an expansion compensation member integrally disposed with respect to the device, the expansion compensation member being adapted to change in length and thus retard axial contraction of the device upon radial expansion of the device from the collapsed configuration to the expanded configuration; and an expansion mechanism, wherein the expansion mechanism biases the device from the collapsed configuration to the expanded configuration.

16. The system as recited in claim 15, wherein the device comprises a sand-screen.

17. The system as recited in claim 15, wherein the device comprises a plurality of slots arranged in a generally parallelogramic shape.

18. The system as recited in claim 15, wherein the expansion compensation member comprises a spring portion.

19. The system as recited in claim 15, wherein the expansion compensation member comprises a rotational segment.

20. The system as recited in claim 15, wherein the expansion compensation member undergoes plastic deformation during expansion.

21. The system as recited in claim 15, wherein the expansion compensation member is adapted to elastically deform.

22. The system as recited in claim 15, wherein the expansion mechanism comprises a cone.

23. A method for deploying an expandable device in a wellbore, comprising:

inserting an expandable device into a wellbore, the device being in a collapsed configuration;

expanding the device to an expanded configuration from the collapse configuration such that the axial length of the device remains substantially constant, the expanding comprising rotating a rotational segment of the device.

24. The method as recited in claim 23, wherein expanding comprises elastically deforming an expansion portion of the device.

25. The method as recited in claim 23, wherein expanding comprises plastically deforming an expansion portion of the device.

* * * * *